US006163660A

United States Patent [19]

Maeshima et al.

[11] Patent Number: 6,163,660

[45] Date of Patent: Dec. 19, 2000

[54] IMAGE-FORMING MACHINE EQUIPPED WITH AN EXCHANGEABLE DEVELOPING UNIT

[75] Inventors: Masanobu Maeshima; Hiroshi Kubota; Koichi Yasuda; Shigeki Hayashi; Masahiro Hashizume, all of Osaka, Japan

[73] Assignee: Kyocera Mita Corporation, Osaka, Japan

[21] Appl. No.: 08/155,560

[22] Filed: Nov. 22, 1993

[30] Foreign Application Priority Data

Nov. 30, 1992 [JP] Japan ..... 4-321037

[51] Int. Cl.[7] ..... G03G 15/08

[52] U.S. Cl. ..... 399/27

[58] Field of Search ..... 355/200, 245, 355/260, 208, 203; 118/688, 689

[56] References Cited

U.S. PATENT DOCUMENTS

| | | | |
|---|---|---|---|
| 4,141,645 | 2/1979 | Reid et al. | 222/DIG. 1 |
| 4,155,638 | 5/1979 | Blitzer | 118/646 X |
| 4,292,530 | 9/1981 | Nepper et al. . | |
| 4,668,074 | 5/1987 | Hirozane . | |
| 4,734,737 | 3/1988 | Koichi | 118/689 |
| 5,008,711 | 4/1991 | Sakamoto et al. . | |
| 5,021,828 | 6/1991 | Yamaguchi et al. | 355/209 |
| 5,036,358 | 7/1991 | Yoshida . | |
| 5,051,778 | 9/1991 | Watanabe et al. . | |
| 5,160,966 | 11/1992 | Shiina et al. . | |
| 5,220,379 | 6/1993 | Fukuchi et al. | 355/200 |

FOREIGN PATENT DOCUMENTS

| | | |
|---|---|---|
| 0 281 372 | 9/1988 | European Pat. Off. . |
| 0 349 003 | 1/1990 | European Pat. Off. . |
| 56-138761 | 10/1981 | Japan . |
| 57-37373 | 3/1982 | Japan . |

*Primary Examiner*—William J. Royer
*Attorney, Agent, or Firm*—Smith, Gambrell & Russell, LLP

[57] ABSTRACT

The image-forming machine has an electrostatic latent image-bearing member on which an electrostatic latent image will be formed and an exchangeable developing unit. The developing unit includes a developing housing, a developing agent contained in the developing unit and a developing agent applicator for applying the developing agent onto the surface of the electrostatic latent image-bearing member. A counter is provided that counts the number of times the developing unit has been used and that can be reset. In the developing unit is disposed a developing agent depletion detector that detects the depletion of the developing agent. The developing unit further has a reset that resets the counter when the use of the developing unit is started. When the developing agent depletion detector has detected the depletion of the developing agent, a developing unit exchange signal is formed to indicate that the developing unit be renewed. The developing unit exchange signal is formed even when the counter has counted a predetermined number that corresponds to the life of the developing unit.

12 Claims, 4 Drawing Sheets

IMAGE-FORMING MACHINE EQUIPPED WITH AN EXCHANGEABLE DEVELOPING UNIT

FIELD OF THE INVENTION

The present invention relates to an image-forming machine such as an electrostatic copying machine or an electrostatic printing machine and, more specifically, to an image-forming machine equipped with an exchangeable developing unit for developing an electrostatic latent image formed on the surface of an electrostatic latent image-bearing member.

DESCRIPTION OF THE PRIOR ART

In an image-forming machine such as an electrostatic copying machine or an electrostatic printing machine, as is well known, an electrostatic latent image is formed on an electrostatic latent image-bearing member that can be constituted by an electrostatic photosensitive material, the electrostatic latent image is developed into a toner image and, then, the toner image on the electrostatic latent image-bearing member is transferred onto an image-receiving member such as a plain paper. According to image-forming machines disclosed in U.S. Pat. No. 5,028,966 issued to Nobuhiko Kozuka et al., U.S. Pat. No. 5,202,728 issued to Masanobu Maeshima et al., and U.S. Pat. No. 5,153,650 issued to Masanobu Maeshima, use is made of an exchangeable developing unit as a developing means for developing an electrostatic latent image into a toner image. Such an exchangeable developing unit includes a developing housing, a developing agent contained in the developing housing, and a developing agent application means for applying the developing agent onto the surface of the electrostatic latent image-bearing material. The developing agent is usually of the so-called one-component type consisting of the toner only or the two-component type consisting of the toner and the carrier particles. As the developing agent application means, there is preferably used a cylindrical developing sleeve that is rotated in a predetermined direction. The developing agent is held on the peripheral surface of the developing sleeve and is carried to a developing zone.

When the developing agent contained in the developing housing is depleted, the developing unit becomes incapable of carrying out the proper developing. When the developing agent in the developing housing is depleted, therefore, the developing unit must be replaced by a new one. Therefore, it has heretofore been attempted to provide a developing agent depletion detecting means that detects the depletion of the developing agent contained in the developing housing in order to make a signal that warns the user of the necessity of renewing the developing unit when the developing agent depletion detecting means has detected the depletion of the developing agent. The developing agent depletion detecting means is preferably constituted by an optical detector which includes a light-emitting element and a light-receiving element. In the developing housing is disposed a developing agent detection zone having a pair of opposing walls made of a light-transmitting material, the pair of opposing walls being positioned between the light-emitting element and the light-receiving element of the optical detector. When the developing agent is present in the developing housing, the light emitted from the light-emitting element toward the light-receiving element is interrupted by the developing agent. When the developing agent in the developing housing is depleted, the light emitted from the light-emitting element is received by the light-receiving element.

Attention should be given to the following facts in connection with the depletion of the developing agent. The developing agent (the toner in the case of the two-component type developing agent consisting the toner and the carrier particles) is consumed in a relatively large amount through one time developing operations in the case of a developing electrostatic latent image having a large duty ratio, i.e., having an imaged region (region where toner is adhered) at a larger ratio than a non-imaged region (region where no toner is adhered). However, the developing agent is consumed in a relatively small amount through one time developing operations in the case of a developing electrostatic latent image having a small duty ratio. On the other hand, the developing sleeve in the exchangeable developing unit or the related constituent element (e.g., a doctor member that limits the amount of the developing agent carried onto the developing zone that is held on the peripheral surface of the developing sleeve), has a life that usually is so set as to last until the developing agent in the developing housing is depleted. Therefore, when electrostatic images having small duty ratios are repeatedly developed many times, the developing agent will still be remaining in the developing housing and a signal will not be generated to warn the user of the necessity of renewing the developing unit. However, the developing unit has been used in excess of the preset life of the constituent elements and hence, there is a possibility of an undesirable occurrence that the developing operation is not carried out fully properly.

Japanese Utility Model Laid-Open Publication No. 79250/1987 (Sho 62-79250) discloses an image-forming machine equipped with an exchangeable electrostatic photosensitive material unit. This image-forming machine has a counter means which counts the number of times the photosensitive material unit has been used and generates a signal after having counted a predetermined number of times to warn the user of the necessity of renewing the photosensitive material unit. The photosensitive material unit is provided with a reset means which resets the counter means when the new photosensitive material unit that is to be mounted is moved by hand in a predetermined direction in the image-forming machine.

It can be contrived to apply the counter means and reset means disclosed in the above Japanese Utility Model Laid-Open Publication to the developing unit in order to generate a signal that warns the user of the necessity of renewing the developing unit when the counted value of the counter means that counts the number of times the developing unit has been used has reached a value that corresponds to the preset life of the constituent elements of the developing unit. When the electrostatic latent image having a large duty ratio is repeatedly developed many times, the number of times the developing unit has been used is smaller than the life of the constituent elements, and no signal is yet generated to warn the user of the necessity of renewing the developing unit. In this case, however, it is probable that the developing agent in the developing housing will have been depleted and the developing operation can not be executed fully properly.

Furthermore, the reset means disclosed in the above Japanese Utility Model Laid-Open Publication involves a problem that is described below since its resetting operation is based upon the manual operation by the operator. For instance, when the operator may move the photosensitive unit by hand in a predetermined direction in the image-forming machine in order to mount the photosensitive material unit, the counter means may not often be reset as desired in the case where the operator executes unusual operations such as mounting the photosensitive material unit halfway, once discontinuing the operation of moving the photosensitive material unit and pulling the photosensitive material unit out of the image-forming machine, and then executing the operation for mounting the photosensitive material unit again.

SUMMARY OF THE INVENTION

A first object of the present invention is to provide a novel and improved image-forming machine which generates a developing unit exchange signal that warns the user of the necessity of renewing the developing unit either when the developing agent in the developing housing is depleted or when the number of times the developing unit is used has reached the expected life, in order to very reliably prevent the developing unit from being continuously used under undesired conditions.

A second object of the present invention is to provide a novel and improved image-forming machine which, when the use of the renewed developing unit is started, reliably resets the counting means that counts the number of times the developing unit has been used without relying upon the manual operation of the operator such as the operation for mounting the developing unit, and, after the counting means is once reset, reliably prevents the counter means from being inadvertently reset until the developing unit is renewed again.

According to one aspect of the present invention, the above first object is accomplished by an image-forming machine which comprises:

an electrostatic latent image-bearing member on the surface of which an electrostatic latent image is formed;

an exchangeable developing unit for developing electrostatic latent image formed on the surface of said electrostatic latent image-bearing member, said developing unit including a developing housing, a developing agent contained in said developing housing, and a developing agent application means for applying said developing agent onto the surface of said electrostatic latent image-bearing member;

a developing agent depletion detecting means for detecting the depletion of the developing agent that is contained in said developing housing;

a counter means that can be reset and counts the number of times said developing unit is used; and an exchange signal forming means that generates a developing unit exchange signal either when said developing agent depletion detecting means has detected the depletion of the developing agent or when said counting means has counted a predetermined number.

According to a preferred embodiment, said developing housing of said developing unit defines a developing agent detecting region that has a pair of opposing walls made of a light-transmitting material, said developing agent depletion detecting means is constituted by an optical detector that includes a light-emitting element and a light-receiving element, and said pair of opposing walls of said developing agent detecting region are positioned between said light-emitting element and said light-receiving element.

According to another aspect of the present invention, the above second object is accomplished by an image-forming machine which comprises:

an electrostatic latent image-bearing member on the surface of which an electrostatic latent image is formed;

an exchangeable developing unit for developing electrostatic latent image formed on the surface of said electrostatic latent image-bearing member, said developing unit including a developing housing, a developing agent contained in said developing housing, and a developing agent application means for applying said developing agent onto the surface of said electrostatic latent image-bearing member;

a counter means that can be reset and counts the number of times said developing unit is used; and an exchange signal forming means that generates a developing unit exchange signal when said counting means has counted a predetermined number; wherein said developing unit further includes a reset means for resetting said counter means when the use of said developing unit is started.

According to a preferred embodiment, said developing agent application means of said developing unit has a developing sleeve that is rotated in a predetermined direction, and said reset means is constituted by a reset member that is mounted on said developing housing to rotate about a predetermined center axis and to move between an acting position and a non-acting position and is rotated in a predetermined direction when said developing sleeve is rotated. There are provided a reset member detecting means which generates a reset signal to reset said counter means upon detecting said reset member, and a reset member forcibly moving means which forcibly moves said reset member from said acting position to said non-acting position. When said developing unit is not used, said reset means is held at said acting position and when said reset member starts rotating with the rotation of said developing sleeve, said reset member detecting means detects said reset member and, then, said reset member forcibly moving means acts upon said reset member such that said reset member is moved from said acting position to said non-acting position and is held at said non-acting position, and said reset member detecting means detects said reset member when said reset member is held at said acting position but does not detect said reset member when said reset member is held at said non-acting position. The reset member detecting means is constituted by a micro-switch having a detecting arm, and said detecting arm of said micro-switch is positioned within a locus of rotation of said reset member when said reset member is held at said acting position, while it is positioned outside the locus of rotation of said reset member when said reset member is held at said non-acting position. When the reset member is held at said acting position, said reset member forcibly moving means is constituted by a stationary member that interferes the rotation of said reset member. The reset member is mounted on a rotary member that rotates about said center axis, so as to rotate between said acting position and said non-acting position about a deflected axis which is deflected from said center axis. The developing unit has a rotary stirrer means for stirring the developing agent in the developing housing, and said rotary member is a driving gear that is fitted to the rotary shaft of said rotary stirrer means.

Other objects of the present invention and technical advantages accomplished by the present invention will become apparent from the following detailed description in conjunction with the accompanying drawings.

DETAILED DESCRIPTION OF PREFERRED EMBODIMENTS

Figure 1:
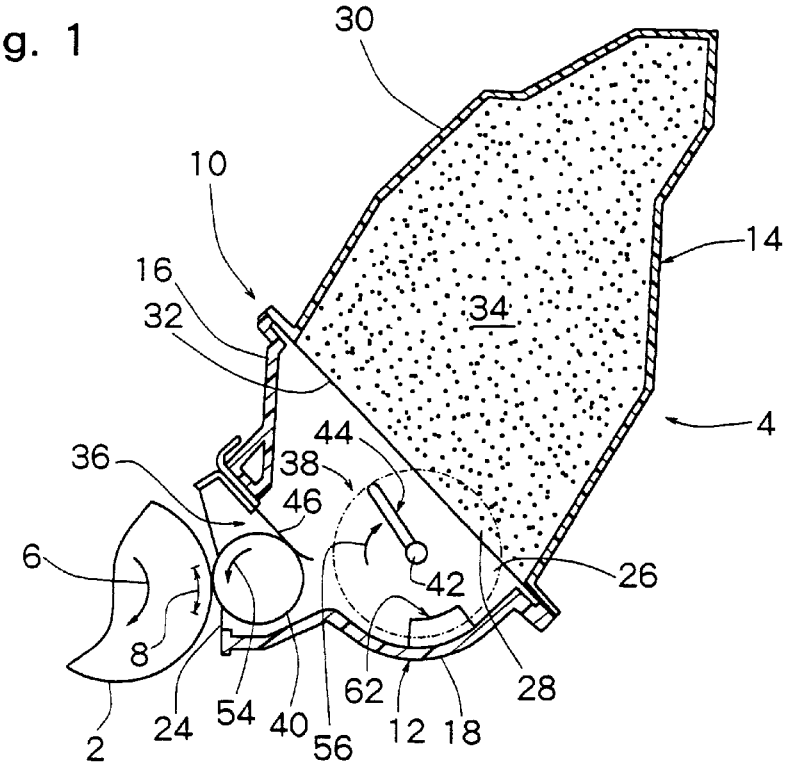
FIG. 1 is a partial sectional view illustrating major portions of an image-forming machine constituted according to the present invention.

Referring now to FIG. 1, the image-forming machine constituted according to a preferred embodiment of the present invention is equipped with a rotary drum 2. On the peripheral surface of the rotary drum 2 is disposed an electrostatic photosensitive material that constitutes an electrostatic latent image-bearing member. The image-forming machine further has a developing unit 4 which is disposed neighboring the rotary drum 2. The developing unit 4 is exchangeably mounted and will be exchanged when a developing unit exchange signal is given as will be described later in detail. The rotary drum 2 is rotated in a direction indicated by arrow 6. An electrostatic latent image is formed on the electrostatic photosensitive material according to a widely known method and is then developed into a toner image by the action of the developing unit 4 in the developing zone designated at 8. The toner image is transferred onto an image-receiving member which may, for example, be a plain paper and is fixed thereon, and the image-receiving member having the toner image fixed thereon is discharged as a copied matter or a printed matter from the image-forming machine. After the toner image is transferred, the residual toner is removed from the electrostatic photosensitive material. It is thus allowed to repeatedly form the electrostatic latent image on the electrostatic photosensitive material.

The developing unit 4 includes a developing housing 10 which is constituted by a support frame portion 12 and a container portion 14 that are coupled together as a unitary structure by adhesion or by any other means. The support frame portion 12 has an upper wall 16 and a lower wall 18 as well as a front wall (not shown) and a rear wall 22 (see FIG. 2). The upper wall 16 and the lower wall 18 extend in the direction of width (in a direction perpendicular to the surface of the paper in FIG. 1). An opening 24 is formed in the support frame portion 12 on the side facing the rotary drum 2 and an opening 26 is formed on the opposite side. The container portion 14 is constituted by a box 30 having an opening 28 that faces the opening 26 of the support frame portion 12 and by a sealing member 32 that removably seals the opening 28. A developing agent 34 is contained in a closed space that is defined by the box 30 and the sealing member 32. The developing agent 34 may be a one-component type agent which is composed of the toner only. A developing agent application means 36 and a stirrer means 38 are disposed between the front wall and the rear wall 22 of the support frame portion 12. The developing agent application means 36 has a developing sleeve 40 of a cylindrical shape that is rotatably mounted. The stirrer means is constituted by a rotary shaft 42 that extends in the direction of width and a plurality of stirrer members 44 mounted on the rotary shaft 42. On the support frame portion 12 is further disposed a developing agent limiting piece 46 of which the free end is pressed onto the surface of the developing sleeve 40.

Figure 2:
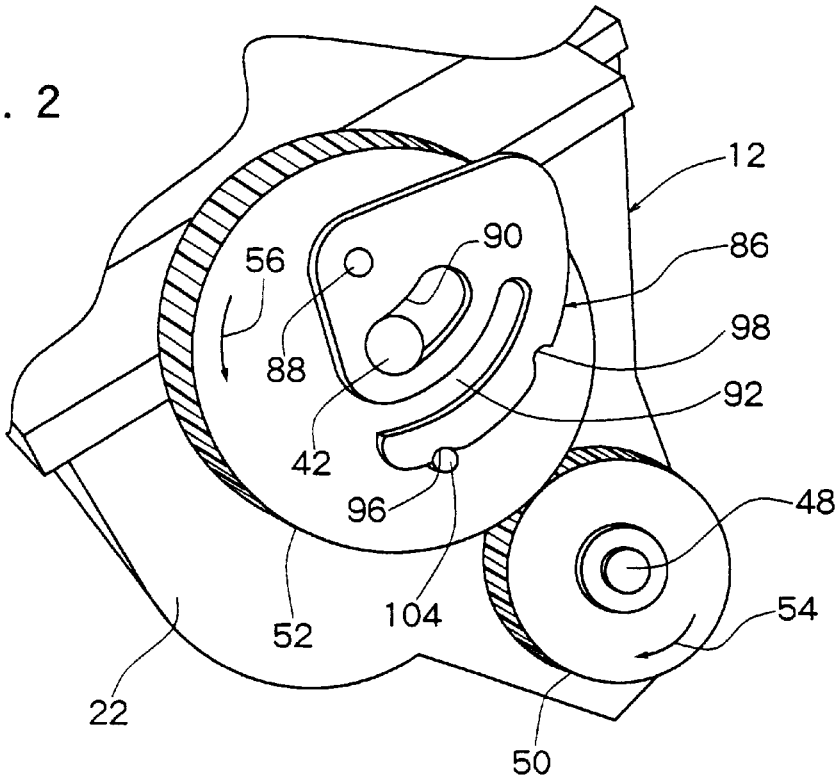
FIG. 2 is a partial perspective view illustrating the rear end portion of a developing unit in the image-forming machine shown in FIG. 1.

With reference to FIG. 2 together with FIG. 1, the developing sleeve 40 of the developing agent application means 36 is fastened to the rotary shaft 48 of which the one end rearwardly protrudes beyond the rear wall 22 of the support frame portion 12. A gear 50 is secured to the protruded rear end of the rotary shaft 48. The rotary shaft 42 of the stirrer means 38 also rearwardly protrudes beyond the rear wall 22 of the support frame portion 12, and a gear 52 is secured to the protruded rear end thereof. The gear 52 is engaged with the gear 50.

After the developing unit 4 is mounted in a required position in the image-forming machine, the sealing member 32 is removed (as for the form of the removable sealing member 32, see, for example, the aforementioned U.S. Pat. No. 5,153,650), whereby the opening 28 of the container portion 14 is communicated with the opening 26 of the support frame portion 12, and the developing agent 34 contained in the container portion 14 is allowed to flow into the support frame portion 12. When the developing unit 4 is mounted at a required position in the image-forming machine, the gear 50 of the developing agent application means 36 is connected, via a suitable transmission means, to a drive source (not shown) which may be an electric motor. To develop the electrostatic latent image on the electrostatic photosensitive material disposed on the peripheral surface of the rotary drum 2, the developing sleeve 40 is rotated in a direction indicated by arrow 54 and the stirrer member 44 is rotated in a direction indicated by arrow 56. The stirrer member 44 causes the developing agent 34 to flow toward the developing sleeve 40, the developing sleeve 40 holds the developing agent 34 on the peripheral surface thereof to convey it to the developing zone 8 where the developing agent is applied to the peripheral surface of the rotary drum 2 to develop the electrostatic latent image into the toner image. The developing agent limiting piece 46 limits the amount of the developing agent 34 that is held on the peripheral surface of the developing sleeve 40 and then conveyed to the developing zone 8 and electrically charges the developing agent 34 into a predetermined polarity.

The constitution of the above-illustrated image-forming machine is not to create a novel feature of the image-forming machine that is improved according to the present invention and may hence be a widely known one. Therefore, the constitution of the image-forming machine is not described in detail in this specification.

Figure 3:
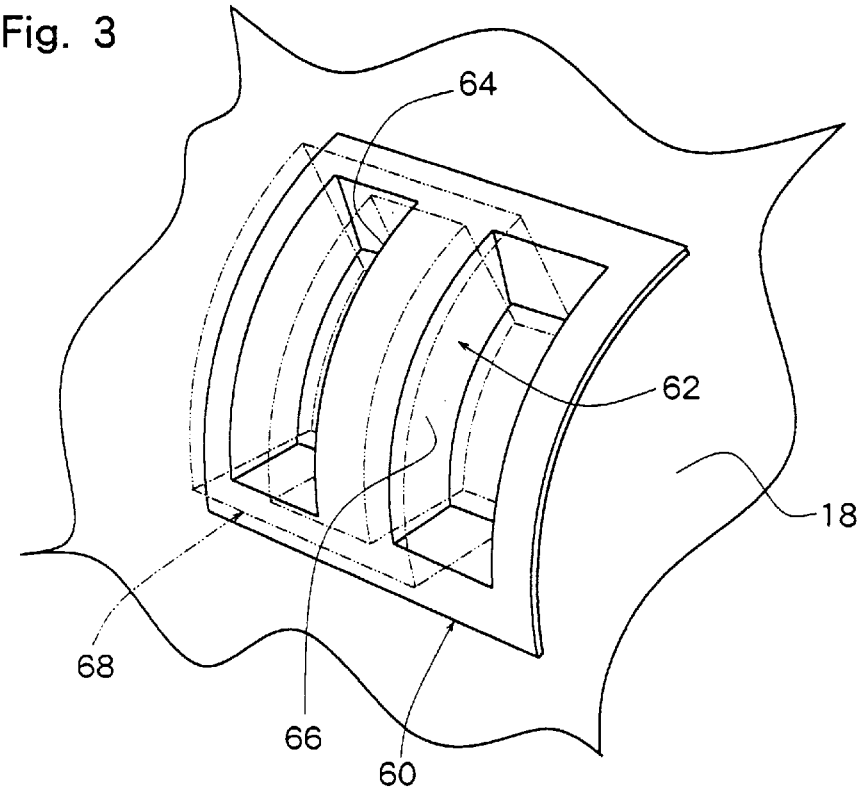
FIG. 3 is a partial perspective view illustrating a developing agent detecting region of the developing unit in the image-forming machine shown in FIG. 1 and a developing agent depletion detecting means provided in relation thereto.
Figure 4:
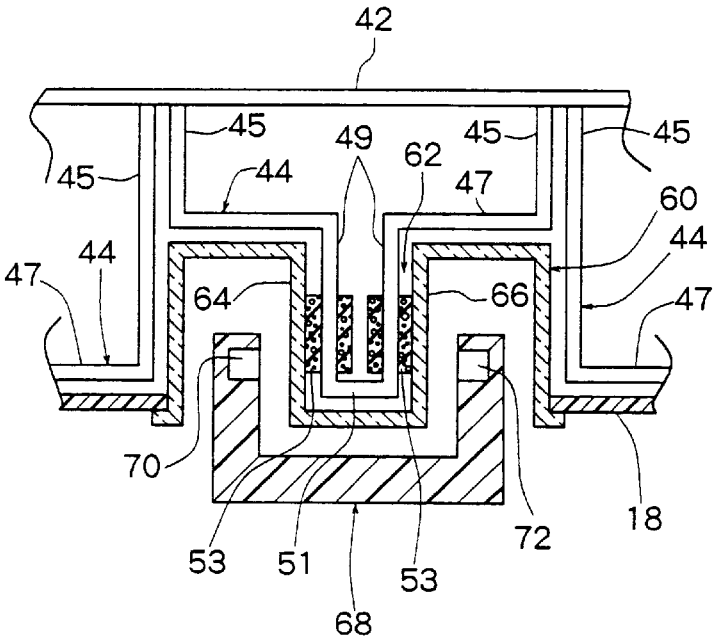
FIG. 4 is a partial sectional view illustrating the developing agent detecting region and the developing agent depletion detecting means shown in FIG. 3.

With reference to FIGS. 3 and 4 together with FIG. 1, a rectangular opening is formed in the lower wall 18 at a central portion in the direction of width thereof in the support frame portion 12 of the developing housing 10, and to this opening is fitted a separately formed member 60 made of a light-transmitting material which may be a transparent or a semi-transparent synthetic resin. On both sides of the member 60 are formed rectangular parallelopiped recessed portions, and between these recessed portions is formed a developing agent detecting region 62 having a pair of opposing walls 64 and 66.

As is clearly illustrated in FIG. 4, a plurality of the stirrer members 44 in the stirrer means 38 are mounted to a rotary shaft 42 in parallel in the axial direction. Each of the stirrer members 44 is constituted by a rod having a pair of radially-extended portions 45 that extend, spaced from each other in the axial direction, outwardly in the radial direction from the rotary shaft 42 and an axially-extended portion 47 that extends in the axial direction between the pair of radially-extended portions 45. In the stirrer member 44 that is positioned correspondingly to the developing agent detecting region 62, the pair of the radially-extended portions 45 are short in length compared with those of the other stirrer members 45 and a protruding portion is formed at the middle of the axially-extended portion 47. This protruding portion has a pair of radially-extended portions 49 extending, spaced at a short distance in the axial direction, outwardly in the radial direction and an axially-extended portion 51 extending in the axial direction between the pair of the radially-extended portions 49. Each of the pair of radially-extended portions 49 is provided with a cleaning member 53 that may be a sponge. As will be understood by referring to FIG. 4, the protruding portion of the stirrer member 44 that is positioned correspondingly to the developing agent detecting region passes between the opposing walls 64 and 66 during the rotation of the rotary shaft 42, and at this occasion of passage, the cleaning member 53 cleans the inside surfaces of the pair of the walls 64 and 66. A developing agent depletion detecting means 68 is disposed in the image-forming machine. It is desired that the developing agent depletion detecting means 68 is constituted by an optical detector having a light-emitting element 70 and a light-receiving element 72 that are positioned in an opposing manner. When the developing unit 4 is mounted at a required position in the image-forming machine, the developing agent detecting region 62 is positioned correspondingly to the developing agent depletion detecting means 68. More specifically, the light-emitting element 70 and the light-receiving element 72 of the developing agent depletion detecting means 68 are caused to enter into the recessed portions formed on both sides of the developing agent detecting region 62, and the pair of the opposing walls 64 and 66 of the developing agent detecting region 62 are brought to be positioned between the light-emitting element 70 and the light-receiving element 72 of the developing agent depletion detecting means 68.

Figure 5:
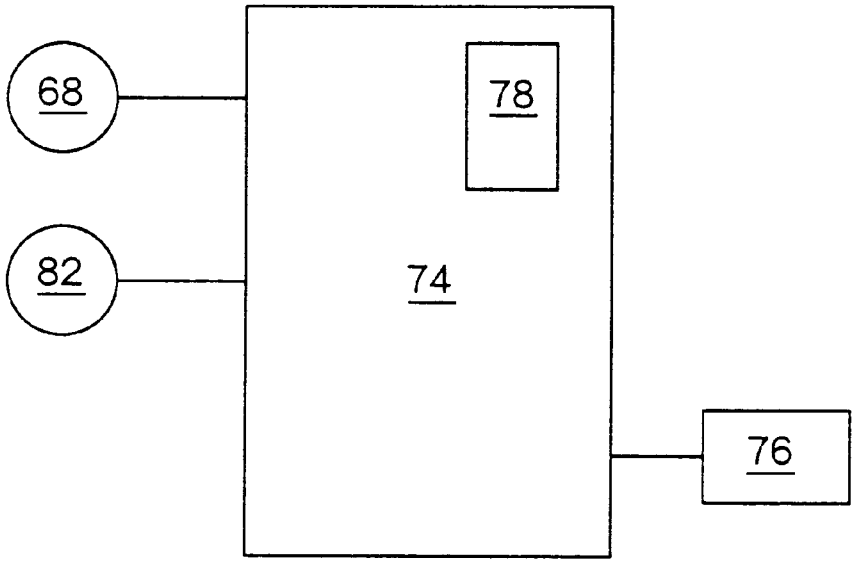
FIG. 5 is a schematic block diagram illustrating a control means and its related elements in the image-forming machine shown in FIG. 1.

When the developing agent 34 exists in a sufficient amount in the developing housing 10, the area between the pair of opposing walls 64 and 66 of the developing agent detecting region 62 is filled with the developing agent 34. Therefore, the light emitted from the light-emitting element 70 is interrupted by the developing agent 34 and is not received by the light-receiving element 72. When the developing agent 34 in the developing housing 10 depletes, however, the amount of the developing agent 34 between the pair of opposing walls 64 and 66 in the developing agent detecting region 62 drastically decreases, and the light emitted from the light-emitting element 70 is received by the light-receiving element 72. (The developing agent 34 adhered to the inside surfaces of the pair of opposing walls 64 and 66 is removed by the cleaning member 53 and hence, the walls 64 and 66 can transmit light.) Then, the developing agent depletion detecting means 68 generates a developing agent depletion signal to indicate the depletion of the developing agent 34 in the developing housing 10. With reference to FIG. 5, the developing agent depletion signal is fed to a control means 74 which can be constituted by using a microprocessor. Upon receipt of the developing agent depletion signal, the control means 74 forms a developing unit exchange signal which is then fed to a warning means 76 which may, for example, be a warning lamp arranged on an operation panel to energize it. Thus, the user is warned of the necessity of renewing the developing unit 4.

With further reference to FIG. 5, the image-forming machine further has a counter means 78 constituted by a counter that can be reset and that is built in the control means 74. The counter means 78 adds 1 every time when the electrostatic latent image is developed by the developing unit 4 (i.e., counts the number of times of developing by the developing unit 4). The number of times the electrostatic latent image has been developed can be learned by detecting, for example, the rotation of the rotary drum 2 or by detecting the feed of the image-receiving member onto which is transferred the toner image from the rotary drum 2. When the counted value of the counter means 78 arrives at a predetermined number that has been beforehand set depending upon the life of the developing unit 4, the counter means 78 generates a life signal which is then fed to the control means 74. Even upon receipt of the life signal, the control means 74 forms the developing unit exchange signal which is then fed to the warning means 76 that warns the user of the necessity of renewing the developing unit 4. As will be clearly understood from the following description, the counter means 78 is reset when the developing unit 4 is renewed and is started to be used, irrespective of whether the counter means 78 has counted a predetermined number or not (or, in other words, irrespective of whether the developing unit 4 is renewed as a result of a predetermined number having been counted by the counter means 78 or whether the developing unit 4 is renewed as a result of the depletion of the developing agent having been detected by the developing agent depletion detecting means 68).

Figure 6:
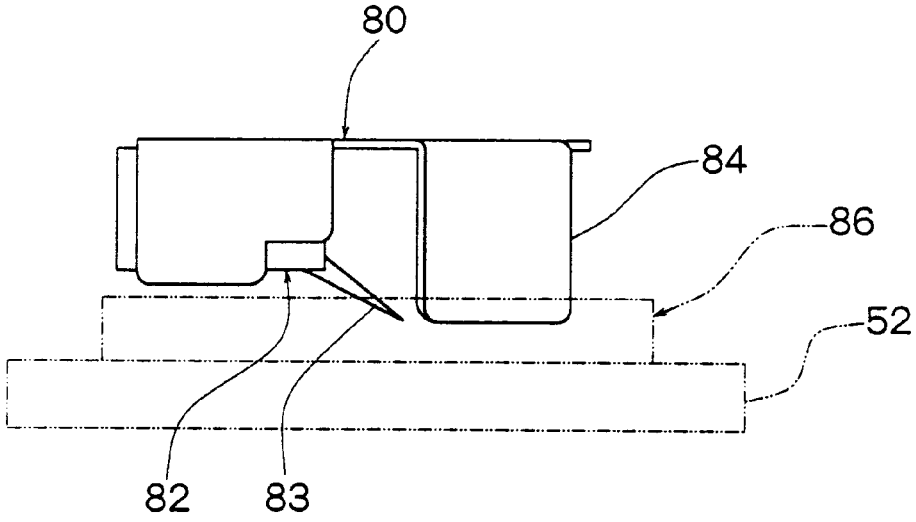
FIG. 6 is a partial plan view illustrating a reset member in the image-forming machine shown in FIG. 1, and a reset member detecting means and a reset member forcibly moving means that are provided in relation thereto.

With reference to FIG. 6, a bracket 80 is secured at a predetermined position in the image-forming machine, and a reset member detecting means 82 is fitted to the bracket 80. The illustrated reset member detecting means 82 is constituted by a micro-switch having a detecting arm 83. The bracket 80 is formed integrally with a stationary member 84 that constitutes a reset member forcibly moving means.

Figure 7:
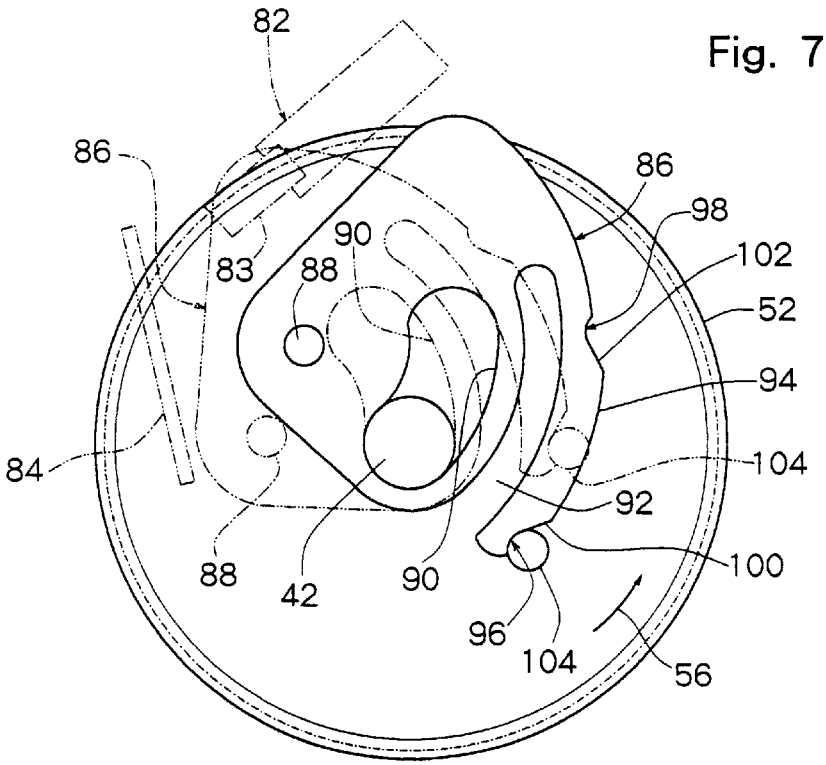
FIGS. 7 and 8 are schematic side views for explaining the mutual actions among the reset member, reset member detecting means and reset member forcibly moving means shown in FIG. 6.
Figure 8:
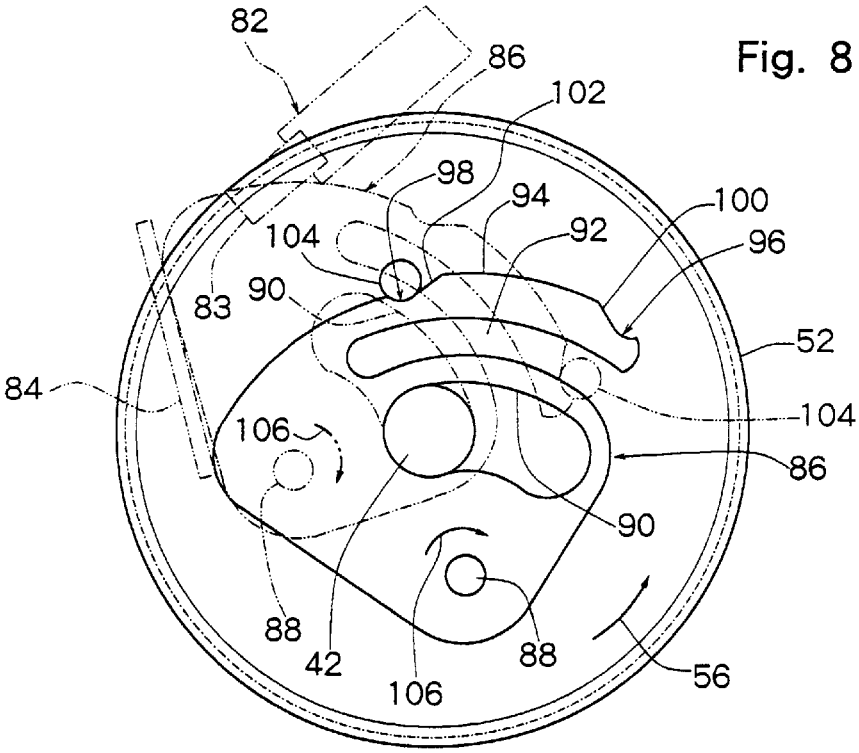

When the description is continued with reference to FIG. 6 together with FIGS. 2, 7 and 8, a reset member 86 that constitutes a reset means is mounted on the gear 52 that is secured to the protruding rear end of the rotary shaft 42 (to which is secured the stirrer member 44 of the stirrer means 38) that protrudes beyond the rear wall 22 of the developing unit 4. On the outer surface of the gear 52 is formed a support shaft 88 that rearwardly extends being deviated from the rotary shaft 42. The reset member 86 is nearly of a fan shape (segment) and is rotatably mounted on the support shaft 88. In the reset member 86 is formed a slit 90 that extends in an arcuate shape with the support shaft 88 as a center, and the rear end of the rotary shaft 42 to which the gear 52 is secured is inserted in the slit 90. Therefore, the reset member 86 that rotates about the support shaft 88 is limited to rotate between an angular position at which the rotary shaft 42 is positioned at one end of the slit 90, i.e., the acting position shown in FIG. 7 and an angular position at which the rotary shaft 42 is positioned at the other end of the slit 90, i.e., the non-acting position shown in FIG. 8. In the reset member 86 is further formed a notch 92 that arcuately extends on the outside of the slit 90, and an arcuate portion 94 extends in an arcuate form on the outside of the notch 92. A first engaging notch 96 and a second engaging notch 98 are formed at a distance in the outer peripheral edge of the arcuate portion 94. The first engaging notch 96 is nearly of a semi-circular shape, one side thereof (side closer to the second engaging notch 98) forming a tilted edge 100 that extends, being mildly tilted, outwardly in the radial direction toward the second engaging notch 98. Similarly, the second engaging notch 98 is nearly of a semi-circular shape, one side thereof (side closer to the first engaging notch 96) forming a tilted edge 102 that extends, being mildly tilted, outwardly in the radial direction toward the first engaging notch 96. On the outer surface of the gear 52 is further formed an engaging pin 104 which has a circular shape in cross section.

Before the developing unit 4 is used, the reset member 86 is at the acting position shown in FIG. 7. At the acting position, the engaging pin 104 engages with the first engaging notch 96 of the reset member 86, whereby the reset member 86 is held at the acting position. When the developing unit 4 is mounted at the required position in the image-forming machine, the gear 50 secured to the rotary shaft 48 of the developing agent application means 36 is connected to the drive source (not shown) as mentioned earlier, and hence, the gear 52, too, is connected to the drive source via the gear 50. When the drive source is energized to use the developing unit 4 after the sealing member 32 is removed from the developing unit 4, the gear 50 is rotated in a direction indicated by arrow 54 and the gear 52 is rotated in a direction indicated by arrow 56. Then, with the rotation of the gear 52, the reset member 86 is rotated about the rotary shaft 42 in the direction indicated by arrow 56. The reset member 86 that is rotated up to an angular position indicated by a two-dot chain line in FIG. 7, acts upon the detecting arm 83 of the reset member detecting means 82, whereby the reset member detecting means 82 detects the reset member 86 to generate a reset signal. The reset signal is fed to the control means 74 (FIG. 5) which then resets the counted value of the counter means 78 to zero. As the reset member 86 is turned up to an angular position indicated by a two-dot chain line shown in FIG. 8 beyond the angular position indicated by the two-dot chain line in FIG. 7, the front end of the reset member 86 in the rotational direction comes in contact with the stationary member 84. Therefore, the reset member 86 is prevented from further rotating in the direction of arrow 56. Thereafter, the gear 54 continues to rotate in the direction indicated by arrow 56. Therefore, the reset member 86 is rotated about the support shaft 88 in the direction indicated by arrow 106 relative to the gear 52 up to the non-acting position indicated by a solid line in FIG. 8. At this moment, the arcuate portion 94 of the reset member 86 is resiliently deformed inwardly in the radial direction, and the engaging pin 104 moves along the tilted edge 100 of the first engaging notch 96 to separate away from the first engaging notch 96. The engaging pin 104 then moves along the tilted edge 102 of the second engaging notch 98 and is brought into engagement with the second engaging notch 98, whereby the arcuate portion 94 of the reset member 86 is resiliently restored outwardly in the radial direction. As the engaging pin 104 comes into engagement with the second engaging notch 98, the reset member 86 is held at the non-acting position. At the non-acting position shown in FIG. 8, the reset member 86 is separated away from the interference by the stationary member 84. After brought to the non-acting position, therefore, the reset member 86 is rotated again in the direction of arrow 56 with the rotation of the gear 52. As will be easily understood from FIGS. 7 and 8, when the reset member 86 is at the acting position, the detecting arm 83 of the reset member detecting means 82 is positioned inside the locus of rotation of the reset member 86 and, hence, the reset member detecting means 82 detects the reset member 86. However, as the reset member 86 is brought to the non-acting position, the detecting arm 83 of the reset member detecting means 82 is brought to a position which is separated away from, and is on the outside of, the locus of rotation of the reset member 86. Therefore, the reset member detecting means 82 does not detect the reset member 86. As described above, when the new developing unit 4 is mounted and is started to be used, the reset member detecting means 82 automatically detects the reset member 86, whereby the counter means 78 is reliably reset. The counter means that is once reset is reliably prevented from being reset again until the developing unit 4 is replaced by the next new one which is then started to be used.

As will be understood from FIG. 1, under the condition where the sealing member 32 of the developing unit 4 is not removed but exists at the illustrated position, the stirrer member 44 secured to the rotary shaft 42 comes in contact with the sealing member 32. Therefore, the reset member is prevented from being accidentally rotated to the angular position indicated by the two-dot chain line in FIG. 7 or to the angular position indicated by the two-dot chain line in FIG. 8. Accordingly, the reset member detecting means 82 detects the reset member 86 or the reset member 86 is reliably prevented from rotating to the non-acting position from the acting position before the use of the developing unit 4 is started.

According to the above-mentioned image-forming machine, the user is warned of the necessity of renewing the developing unit 4 either when the developing agent 34 of the developing unit 4 is depleted or when the number of times of developing by the developing unit 4 has reached a predetermined number (i.e., when the developing unit 4 is used up to the end of its life span). Thus, the developing unit 4 is reliably prevented from being continuously used under undesired conditions. Furthermore, when the use of the renewed developing unit 4 is started, the counter means 78 that counts the number of times the developing unit 4 is used is reliably reset. After once reset, furthermore, the counter means 78 is reliably prevented from being inadvertently reset until the developing unit 4 is renewed again. Thus, the number of times the developing unit 4 is used is properly counted at all times.

Although the image-forming machine constituted according to preferred embodiments of the present invention was described above in detail in conjunction with the accompanying drawings, it should be noted that the present invention is in no way limited to the above-mentioned embodiments only but can be changed or modified in a variety of other ways without departing from the scope of the invention.

What we claim is:

1. An image-forming machine comprising:

an electrostatic latent image-bearing member on the surface of which an electrostatic latent image is formed;

an exchangeable developing unit for developing an electrostatic latent image formed on a surface of an electrostatic latent image-bearing member, said developing unit including a developing housing, a developing agent contained in said developing housing, and a developing agent application means for applying said developing agent onto a surface of an electrostatic latent image-bearing member;

a developing agent depletion detecting means for detecting the depletion of the developing agent from said developing housing;

a counter means that can be reset and counts the number of times said developing unit is used;

an exchange signal forming means that generates a developing unit exchange signal either when said developing agent depletion detecting means has detected the depletion of the developing agent or when said counting means has counted a predetermined number; and a reset means disposed in said developing unit, said reset means resetting said counter means when the use of said developing unit is started.

2. An image-forming machine according to claim 1, wherein:

said developing agent application means of said developing unit has a developing sleeve that is rotatable in a first predetermined direction;

said reset means is constituted by a reset member that is mounted on said developing housing to rotate about a predetermined center axis and to move between an acting position and a non-acting position, and which is rotated in a second predetermined direction when said developing sleeve is rotated;

there are provided a reset member detecting means which generates a reset signal to reset said counter means upon detecting said reset member, and a reset member forcibly moving means which forcibly moves said reset member from said acting position to said non-acting position; and when said developing unit is not used, said reset means is held at said acting position and when said reset member starts rotating with the rotation of said developing sleeve, said reset member detecting means detects said reset member and then said reset member forcibly moving means acts upon said reset member such that said reset member is moved from said acting position to said non-acting position and is held at said non-acting position, and said reset member detecting means detects said reset member when said reset member is held at said acting position but does not detect said reset member when said reset member is held at said non-acting position.

3. An image-forming machine according to claim 2, wherein said reset member detecting means is constituted by a micro-switch having a detecting arm, said detecting arm of said micro-switch being positioned within a locus of rotation of said reset member when said reset member is held at said acting position, while said detecting arm is positioned outside the locus of rotation of said reset member when said reset member is held at said non-acting position.

4. An image-forming machine according to claim 2, wherein when said reset member is held at said acting position, said reset member forcibly moving means is constituted by a stationary member that interferes with the rotation of said reset member.

5. An image-forming machine according to claim 2, wherein said reset member is mounted on a rotary member that rotates about said center axis, so as to rotate between said acting position and said non-acting position about a deflected axis which is deflected from said center axis.

6. An image-forming machine according to claim 5, wherein said developing unit has a rotary stirrer means for stirring the developing agent contained in the developing housing, and said rotary member is a driving gear that is fitted to the rotary shaft of said rotary stirrer means.

7. An image-forming machine comprising:

an electrostatic latent image-bearing member on the surface of which an electrostatic latent image is formed;

an exchangeable developing unit for developing an electrostatic latent image formed on a surface of an electrostatic latent image-bearing member, said developing unit including a developing housing, a developing agent contained in said developing housing, and a developing agent application means for applying said developing agent onto a surface of an electrostatic latent image-bearing member;

a counter means that can be reset and counts the number of times said developing unit is used; and an exchange signal forming means that generates a developing unit exchange signal when said counting means has counted a predetermined number; wherein said developing unit further includes a reset means for resetting said counter means when the use of said developing unit is started.

8. An image-forming machine according to claim 7, wherein:

said developing agent application means of said developing unit has a developing sleeve that is rotated in a first predetermined direction;

said reset means is constituted by a reset member that is mounted on said developing housing to rotate about a predetermined center axis and to move between an acting position and a non-acting position and which is rotated in a second predetermined direction when said developing sleeve is rotated;

there are provided a reset member detecting means which generates a reset signal to reset said counter means upon detecting said reset member, and a reset member forcibly moving means which forcibly moves said reset member from said acting position to said non-acting position; and when said developing unit is not used, said reset means is held at said acting position and when said reset member starts rotating with the rotation of said developing sleeve, said reset member detecting means detects said reset member and then said reset member forcibly moving means acts upon said reset member such that said reset member is moved from said acting position to said non-acting position and is held at said non-acting position, and said reset member detecting means detects said reset member when said reset member is held at said acting position but does not detect said reset member when said reset member is held at said non-acting position.

9. An image-forming machine according to claim 8, wherein said reset member detecting means is constituted by a micro-switch having a detecting arm, and said detecting arm of said micro-switch is positioned within a locus of rotation of said reset member when said reset member is held at said acting position, while said detecting arm is positioned outside the locus of rotation of said reset member when said reset member is held at said non-acting position.

10. An image-forming machine according to claim 8, wherein when said reset member is held at said acting position, said reset member forcibly moving means is constituted by a stationary member that interferes with the rotation of said reset member.

11. An image-forming machine according to claim 8, wherein said reset member is mounted on a rotary member that rotates about said center axis, so as to rotate between said acting position and said non-acting position about a deflected axis which is deflected from said center axis.

12. An image-forming machine according to claim 11, wherein said developing unit has a rotary stirrer means for stirring the developing agent contained in the developing housing, and said rotary member is a driving gear that is fitted to the rotary shaft of said rotary stirrer means.

* * * * *